United States Patent [19]

Snaper et al.

[11] Patent Number: 4,863,387

[45] Date of Patent: Sep. 5, 1989

[54] PRINTER CIRCUIT BOARD SEPARABLE CONNECTOR

[76] Inventors: Alvin A. Snaper, 2800 Camero Cir., Las Vegas, Nev. 89107; Jerome D. Snaper, Jahn Strasse 17, 6204 Taunusstein/Hahn, Fed. Rep. of Germany

[21] Appl. No.: 138,308

[22] Filed: Dec. 22, 1987

[51] Int. Cl.[4] ..... H01R 39/00

[52] U.S. Cl. ..... 439/31; 439/13; 439/65

[58] Field of Search ..... 439/11, 13, 28, 29, 439/31, 65, 76

[56] References Cited

U.S. PATENT DOCUMENTS

| | | | |
|---|---|---|---|
| 3,199,059 | 8/1965 | Masse et al. | 439/31 |
| 3,258,736 | 6/1966 | Crawford et al. | 439/65 |
| 4,657,320 | 4/1987 | Bamford et al. | 439/31 |
| 4,715,819 | 12/1987 | Iwasa et al. | 439/31 |

FOREIGN PATENT DOCUMENTS

| | | | |
|---|---|---|---|
| 0251515 | 1/1988 | European Pat. Off. | 439/31 |

OTHER PUBLICATIONS

P. R. Schultz; "Pivot Connector"; IBM Tech. Disclosure Bulletin, vol. 6, No. 3, Aug. 1963, p. 79.

*Primary Examiner*—William L. Sikes
*Assistant Examiner*—B. R. R. Holloway
*Attorney, Agent, or Firm*—Donald D. Mon; David O'Reilly

[57] ABSTRACT

A separable connector for mounting printed circuit boards which permits easy removal or swiveling for repair or replacement. The connector has a chassis or surface mounting header having a plurality of solder connections to interconnect with main circuits. The header has sockets with latches for receiving mounting pins on a cylindrical connector securely attached to a printed circuit board with rivets and solder connections. The cylindrical connector has wrap-around contacts on a cylindrical shaft mating with concave contacts on the header which maintain electrical contact as the circuit board swivels.

5 Claims, 1 Drawing Sheet

PRINTER CIRCUIT BOARD SEPARABLE CONNECTOR

FIELD OF THE INVENTION

This invention relates to electronic plugs and connectors and more particularly relates to a separable connector for mounting printed circuit boards.

BACKGROUND OF THE INVENTION

Printed circuit boards are now almost universally used. A variety of devices and methods are used to connect these boards together. Some include direct wiring with cables such as ribbon cables while others use a plug and socket technique. In the latter the socket is usually permanently attached to a "motherboard" (i.e. a main circuit board) or chassis and the printed circuit board is provided with a plug mounted on one edge called an "edge connector." The printed circuit board (printed circuit board) is installed by simply plugging the printed circuit board edge connector into the socket provided on the main circuit board or chassis.

Plugs on these printed circuit boards exist in various forms. One type of plug is comprised of a plurality of pins mounted in a connector block. The plug is attached to the board by soldering one end of the pins in the plug to printed circuit board pads that surround holes in the board. The other end of the pins plug into a main circuit board or chassis socket.

Another type of known plug is comprised of a plurality of printed circuit board strips terminating at a flange or extension of the printed circuit board itself. These are sometimes called "card edge connectors".

In each of these cases the electrical connection is made by a male pin of printed strip that is being inserted into a metal lined connecting socket. Typically, the metal connectors in the socket make a close tolerance fit, and include a resilient leaf spring type arrangement adapted to maintain good electrical contact with the male pin connections.

In most cases the above-described arrangement is adequate but does have some problems. A significant problem is the accessibility of the board for troubleshooting or for in-circuit testing. When installed, one side of the board will typically be accessible while the other is not. In some cases neither side is very accessible. The solution usually is to unplug and remove the board for circuit testing. This is not an entirely satisfactory alternative because actual circuit conditions are sometimes difficult to simulate. Ideally, all parts of a circuit board should be accessible without removing the board from the circuits. One way to do this is by extension cables which allow the board to be remotely connected. However this requires maintaining a large supply of extension cables, at considerable expense. Even this may not be enough, because the particular cable needed might not be available or the available cable might be too short.

Another difficulty with present printed circuit board connectors is their deteriorated conductivity after long periods of use. Corrosion creeping into the interface between the male and female contacts often interferes with or intermittently interrupts operations. The former is more feared than the latter, because intermittent problems are sometimes the most difficult to find. Further, any contact corrosion is troublesome in the low voltage digital circuits now in use.

Electrical contact sometimes also deteriorates because the spring biased contacts lose their resilience after long periods of use. Corrosion can sometimes be easily corrected by spraying with a contact cleaner, but spring biased contacts which lose their resiliency rquire difficult and costly connector replacement.

It is therefore an object of the present invention to provide an electrical connector which improves in-circuit accessibility to printed circuit boards.

Yet another object of the present invention is to provide a separable connector which improves accessibility and removability of a printed circuit board.

Still another object is to provide a separable connector having a barrel-shaped cylindrical contact area fitting a chassis or main circuit board mountes socket which has latches to secure the printed circuit board connector to allow a printed circuit board to swivel for easy access to all parts of the board while still remaining connected. The latches also firmly hold the separable connector together, keeping electrical conducting surfaces always in good firm contact.

BRIEF DESCRIPTION OF THE INVENTION

The purpose of the present invention is to provide a unique separable connector for mounting printed circuit boards. The connector has male and female halves fitting together and held in intimate electrical contact by latches. While latched, a printed circuit board mounted on the connector can be pivoted around the connectors axis, providing access to the top or bottom of the board for in-circuit testing or trouble shooting.

The printed circuit board half of the connector has a barrel-shaped cylindrical insulated connector terminating in solder pins on a flange. Wrap-around metal conductive strips equally spaced on the barrel-shaped cylindrical insulated connector provide connections to the printed circuit board components. The metal conductive strips terminate in solder pins insertible in holes in the printed circuit board for soldering to conductive pads that form part of the printed circuit. Rigidity is improved by riveting the ends of the barrel-shaped connector to the printed circuit board.

Each wrap-around metal strip provides continuous contact during rotation or pivoting of a board attached thereto. Thus, access to either side of the circuit board is provided while good electrical contact of the connector is maintained.

Interleaved between the contacts are insulating ridges separating the contacts to minimize shorts when connected.

Reversal of connection of the barrel-shaped connector is prevented by keying installation on the connector block. A rib or circumferential shoulder on one end of the barrel-shaped insulator fits a recess or detent on one end of the connector block. The rib on one end of the barrel-shaped connector prevents the pins from being fully seated in the latch sockets thereby preventing reverse installation. This effectively eliminates any possibility of circuit component damage by improper contact connection.

The above and other features of this invention will be fully understood from the following detailed description and the accompanying drawings, in which:

DETAILED DESCRIPTION OF THE INVENTION

Figure 1:
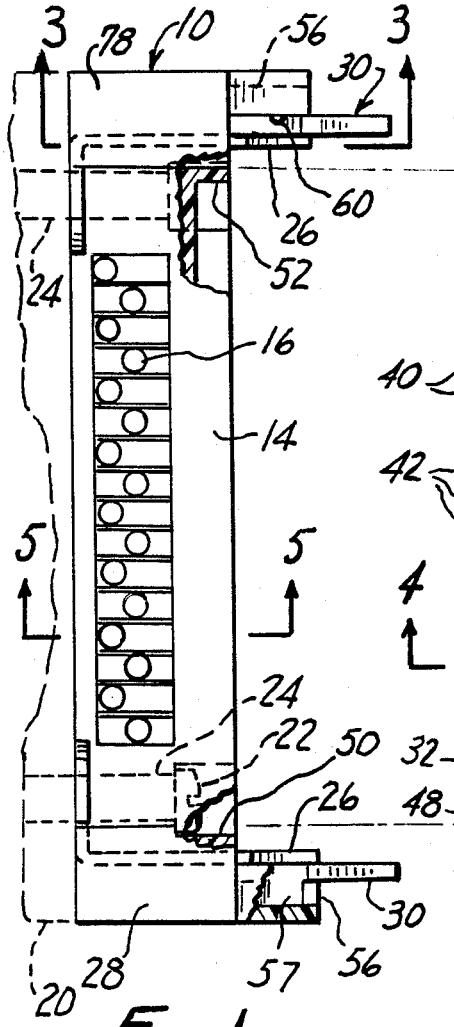
FIG. 1 is a top view of the female socket of the separable connector.
Figure 2:
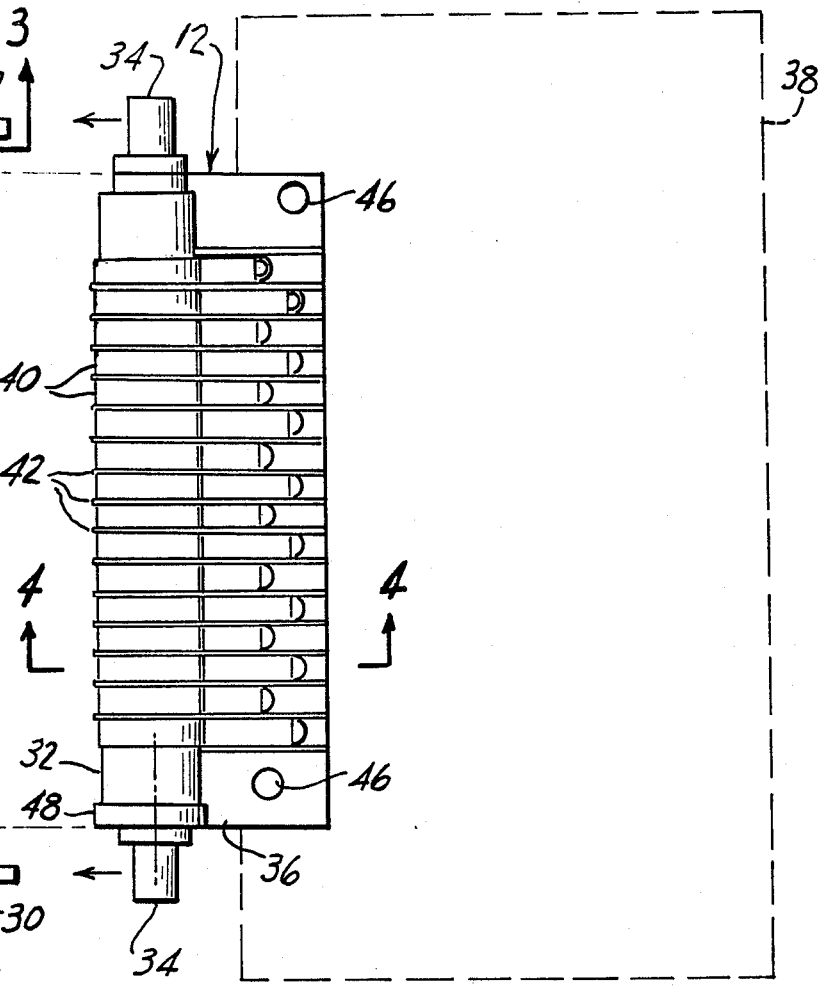
FIG. 2 is a top view of the male plug for the separable connector.

Female socket 10 and male plug 12 are shown respectively in the top views of FIGS. 1 and 2. Female socket 10 is an insulated block 14 having a plurality of encapsulated solder contacts 16, which connect to plug mating contacts 18 (FIG. 5) embedded in insulating block 14. Female socket 10 is mounted on a surface or chassis 20 with mounting screws 22 passing through mounting holes 24 on each end of female socket 10. Mechanical mounting slots for male plug 12 are provided at each end of female socket 10 by end plates 26 secured by end caps 28. End plates 26 also hold rotatable latches 30 in place in end caps 28, the operation of which will be described in greater detail hereinafter.

Male plug 12 is a cylindrical barrel-shaped insulator 32 having hinge pins 34 on each end and a flange extension 36 for attachment to a printed circuit board 38. Electrical contacts 40 are equally spaced along a length, and wrap around the circumference of cylindrical barrel 32 and are separated by insulating ribs 42 formed on barrel 32 and flange 36 to prevent shorting of contacts. Contacts 40 extend out onto both sides of insulating flange extension 36 and terminate at solder pins 44 which engage and are soldered to holes surrounding conductive pads on printed circuit board 38. Attachment of printed circuit board 38 to flange 36 may be strengthened with rivets through rivet holes 46.

Since sensitive electronic components are often used on printed circuit board 38, it is important to prevent improper connection of the board to a circuit. Thus, the socket and plug are constructed to be "keyed" together to prevent reversing the connection. The "key" is a circumferential shoulder 48 on one end of insulating barrel 32. Block 14 of female socket 10 is likewise "keyed" by a recessed undercut 50 on the end receiving shoulder 48 allowing the male plug to fully seat when connected. The opposite end of insulating block 14 has an abutment 52 which will prevent the connector from being fully seated if an attempt is made to reverse the connection.

Figure 3A:
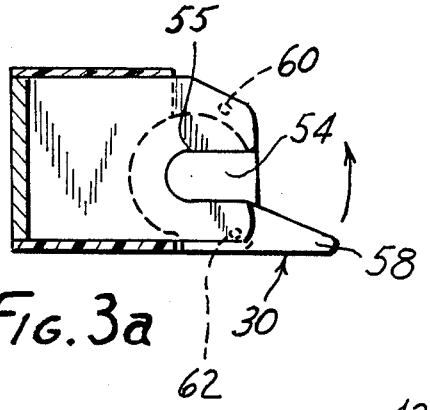
FIGS. 3*a* and 3*b* are sectional views taken at line 3—3 in FIG. 1 illustrating the latch operation to secure the male plug in the female socket.
Figure 3B:
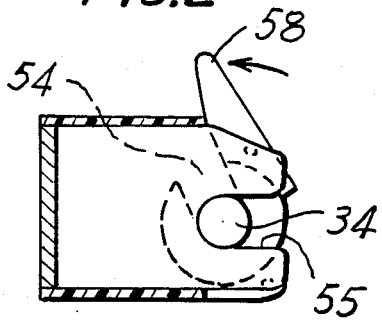
Figure 4:
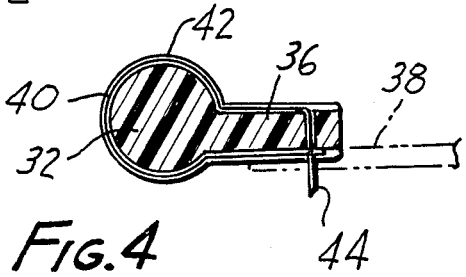
FIG. 4 is a sectional view taken at line 4—4 in FIG. 2.

Male plug 12 is connected to the female socket by inserting hinge pins 34 in sockets formed by hinge pin slots 54, 55 in plate 28, and latch 30 and recess 56 in end caps 28 as can be seen more clearly inn FIGS. 3*a* and 3*b*. A boss 57 on each latch 30 seats in recess 56 in each end cap 28, allowing the latch to freely rotate. Latches 30 are held in place by slotted end plates 26.

Latches 30 are operated by finger pressure on tab 58 to rotate from a first open position with slots 54, 55 in alignment in the closed position as shown in FIG. 3*b* wherein hinge pin 34 is captured in a hinge pin socket between slots 54, 55. Latch 30 is held in an open or closed position by knobs 60, 62 engaging a dimple (not shown) in the surface of tab 58.

The separable connector of the invention allows printed circuit board 38 to be pivoted for access to either side by rotating barrel-shaped plug 12 around the axis through hinge-pins 34. This permits ready access to all circuit connections on the board for in-circuit testing and troubleshooting. Should a defective connection or component be found on the board it can easily be removed by rotating latches 30 to the open position shown in FIG. 3*a* and lifting male plug 12 out to separate the connector. Replacement is the equally easy task of inserting hinge pins into hinge pin slots 54, 55 with circumferential shoulder 48 properly oriented, and rotating tab 58 counter clockwise until knobs 60 snap into place in the dimple in the tab.

Figure 5:
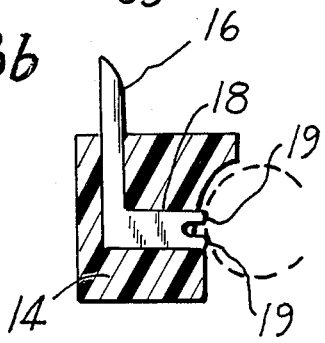
FIG. 5 is a sectional view taken at line 5—5 in FIG. 1.

When male plug 12 is installed and latched to female socket 10, wrap-around contacts 40 mate with fingers 19 on contacts 18 (FIG. 5). The point contacts of fingers 19 provide constant positive electrical contact even when barrel-shaped plug 12 is rotated.

Thus, there has been disclosed a separable connector which allows a printed circuit board to be easily pivoted for access to both sides while in a circuit and allows the board to be easily removed for repair or replacement. The quick connect-disconnect feature eliminates problems inherent in connecting plugs of corroded contacts or contact damage that recur as the consequence of "jockeying" the board during removal.

This invention is not to be limited by the embodiment shown in the drawings and described in the description, which is given by way of example and not of limitation, but only in accordance with the scope of the appended claims.

I claim:

1. A separable connector for printed circuits boards comprising:

a first elongate cylindrical electrical insulator;

a flange extending substantially perpendicular to said first elongate cylindrical electrical insulator;

a plurality of spaced apart electrical contacts wrapped around the cylindrical surface of said elongate cylindrical electrical insulator and terminating in solder contacts substantially perpendicular to said flange;

a second elongate electrical insulator;

a plurality of electrical contacts being embedded in said second electrical insulator;

means for detachably mating said first elongate cylindrical electrical insulator electrical contacts with said second elongate electrical insulator electrical contacts, with one of said electrical insulators being rotatable;

latch means for latching said first elongate cylindrical insulator to said second elongate electrical insulator with said electrical contacts on said first elongate cylindrical connector firmly held in contact with said electrical contacts embedded in said second elongate electrical insulator;

said detachable mating means comprising hinge pins on one of said elongate electrical insulators engaging hinge pin slots on the other of said elongate electrical insulator;

said latch means comprising rotatable plates mounted adjacent said hinge pin slots having slots for receiving said hinge pins so that rotation of said rotatable plates latches said hinge pins in said hinge pin slots whereby a printed circuit board attached to said rotatable electrical insulator may be rotated with said rotatable electrical insulator to provide access to either side of said printed circuit board for testing and repair, and removed by unlatching and separating said rotatable electrical connector.

2. The connector according to claim 1 in which said printed circuit board is firmly attached to said flange extension of said elongate cylindrical electrical insulator for rotation herewith.

3. The connector according to claim 1 in which said contacts embedded in said second elongate electrical connector mating with said electrical contacts wrapped around the circumferential surface of said first elongate cylindrical electrical insulator are constructed with a pair of fingers forming spaced apart point contacts engaging said electrical contacts wrapped around the circumferential surface of said elongate cylindrical electrical insulator to provide constant positive electrical contact when said elongate electrical insulators are mated and during rotation.

4. The connector according to claim 1 including keying means on said first and second elongate electrical insulators to prevent said electrical contacts on said first and second elongate electrical insulators from being incorrectly mated.

5. The connector according to claim 4 in which said keying means on said first and second elongate electrical insulators to prevent said electrical contacts from being incorrectly mated comprises:

a circumferential shoulder on one end of said elongate cylindrical electrical insulator; and a recess in one of said hinge pins slots for receiving said circumferential shoulder, whereby said first and second electrical connectors can be mated in only one orientation.

* * * * *